US006688486B2

(12) United States Patent
Diamond et al.

(10) Patent No.: US 6,688,486 B2
(45) Date of Patent: Feb. 10, 2004

(54) EASY OPEN END AND CAN FOR POWDERS

(75) Inventors: George B. Diamond, 62 Anthony Rd., Glen Gardner, NJ (US) 08826; Ralph H. Helmrich, Asbury, NJ (US)

(73) Assignee: George B. Diamond, Glen Gardner, NJ (US)

( * ) Notice: Subject to any disclaimer, the term of this patent is extended or adjusted under 35 U.S.C. 154(b) by 100 days.

(21) Appl. No.: 09/951,275

(22) Filed: Sep. 11, 2001

(65) Prior Publication Data

US 2003/0150863 A9 Aug. 14, 2003

Related U.S. Application Data

(60) Provisional application No. 60/232,085, filed on Sep. 12, 2000, and provisional application No. 60/265,481, filed on Jan. 31, 2001.

(51) Int. Cl.[7] ..... B65D 51/16

(52) U.S. Cl. ..... 220/785; 220/359.2; 220/366.1; 220/367.1; 220/373

(58) Field of Search ..... 220/271, 785, 220/366.1, 367.1, 369, 373, 374, 269, 270, 359.2, 789–791, 801, 802; 215/307, 309

(56) References Cited

U.S. PATENT DOCUMENTS

| | | | | |
|---|---|---|---|---|
| 3,494,500 A | * | 2/1970 | Foster | 220/270 |
| 4,146,149 A | | 3/1979 | Beveridge | |
| 4,225,045 A | | 9/1980 | Rayner et al. | |
| 4,413,748 A | | 11/1983 | Kessler et al. | |
| 4,620,642 A | | 11/1986 | Wertz et al. | |
| 5,445,291 A | | 8/1995 | Daniel | |
| 5,688,544 A | | 11/1997 | Bolton et al. | |
| 5,791,473 A | | 8/1998 | Decker et al. | |
| 5,806,710 A | | 9/1998 | Shiffer et al. | |

* cited by examiner

*Primary Examiner*—Nathan J. Newhouse
(74) *Attorney, Agent, or Firm*—Ostrolenk, Faber, Gerb & Soffen, LLP

(57) ABSTRACT

A can and easy open closure for the can which is structured and arranged to cooperate with the can such that as the closure is removed from the can, gas is allowed to escape while the contents of the can, such as a powder, is prevented from escaping.

14 Claims, 3 Drawing Sheets

EASY OPEN END AND CAN FOR POWDERS

RELATED APPLICATIONS

This application is based on and claims priority to Provisional Application Serial No. 60/232,085 entitled "A RESEALABLE EASY OPEN END FOR POWDERS", filed Sep. 12, 2000, the entire disclosure of which is incorporated by reference herein and to U.S. Provisional Application Serial No. 60/265,481, entitled "AN IMPROVED RECLOSABLE EASY OPEN END COVER FOR NON-PROCESSED FOOD PRODUCTS", filed Jan. 31, 2001, the entire disclosure of which is incorporated by reference herein.

BACKGROUND OF THE INVENTION

This invention relates to a reclosable easy open closure or end for containers such as cans, jars, bottles and the like, and, more particularly, to such an end for use in sealing containers containing powdered or granulated material.

Easy open ends ("EOE") are can ends (tops) which have a score line or similar weakening segment which weakens the end against a tearing type force but maintain a strength against a vacuum and/or a pressure type force. A pull tab is part of the end and by pulling on the tab the segment of the end which is inside the score line tears off, thus opening the can without the use of a can opener.

In the case of an adhesively sealed EOE, usually the entire EOE is removed. In the case of drinks (soft drinks, beer, non-carbonated drinks, juices and similar products) only a small section of the end is torn off (or sometimes pushed in and left on inside the can or lifted and left on the outside of the can).

In the case of soups, meats, etc., most of the end is torn off leaving a small segment which is outside the score line (i.e. towards the can wall). If heat or adhesively sealed, no score line is necessary and the entire segment is removed, although a heat or adhesive seal with a score line can also be used.

In the case of an easy open end that is used for sterilized foods such as meat, fish, soups, vegetables, fruits, etc., the part that is torn off is at present usually discarded and no provision for a reseal is generally made—the cans generally being of such size that they are single-use cans or, if multi-use cans, the contents are either transferred to a different closeable container (such as a freezer or refrigerator sealable container) or the top of the opened can is wrapped with foil or plastic.

In those cases not requiring sterilization of the contents, such as dry foods, nuts coffee, candy, crisps (potato or other chips), pretzels and other snack foods, and in the case of bird seed or even sporting goods (e.g. tennis balls) and industrial products (e.g. chemicals or small parts), if an easy open end (which in these cases can also be a membrane (scored or unscored) glued or heat sealed to the container) is provided, a separate plastic snap-on cover is usually also provided the container itself can be metal, plastic or composite (paper-foil-plastic). Generally, membranes are not used where the products are under substantial pressure or vacuum.

In the case of easy open ends for beverages (soft drinks, beer and non-carbonated beverages), which ends have a small section which is scored or attached with adhesive, the loss of carbonation and/or the sanitary requirements make it difficult to store these products even for a short time, and therefore a screw or bayonet type resealable cap is provided, and this requires two hands to reseal.

Since a resealable easy open end is very useful and desirable, the prior art shows many patents dealing with resealable easy open ends. These patents have common factors, namely, that there is a frame member attached to the can and to which the resealable easy open end is attached. Additionally, these patents may or may not have a tear strip which is attached to the frame member, and may or may not have a part of the end remaining on the can. In all of these cases, there is a plurality of pieces which have to be used to achieve the required function. This group includes U.S. Pat. Nos. 5,758,793, 5,617,968, 5,511,679, 5,125,528, 5,085,339, 5,050,763, 5,042,680, 5,020,686, 4,724,979, 4,724,978, 4,699,290, 4,682,706, 4,660,735, 4,529,100 and 3,557,998.

The partly open end makes it difficult to remove the contents, and the plastic ring to which the end is sealed makes it much more expensive, i.e., two parts instead of one part. The end is also awkward to reseal since two hands have to be used, one to force it over the rim or other protrusion and the other to hold the can against this force.

These ends are expensive since either a frame member has to be molded in addition to the removable section or a separate closing cap has to be provided. In addition to the cost which can represent a factor of as much as 20%–80% if not more of the cost of the can, these ends are environmentally unfriendly because either a plastic throw away overcap or an injection molded frame member are needed.

In some cases a hinged flap is also required and part of the lid stays on the can even if it is not a separate member, or a tear strip is required. This group includes U.S. Pat. Nos. 5,145,085, 5,085,339, 5,050,763., 4,741,450, 4,724,979, 4,724,978, 4,699,290, 4,473,168, 4,434,907, 4,433,793, 4,427,128, 4,385,708, 4,165,016, 3,998,354, 3,557,998, 3,356,250 and 2,998,158.

In all of the above patents there is at least one or a combination of a separate frame member that stays on the can, a hinged cover, a part of the cover that stays on the can, a tear strip, a weakening member combined with one of the above, a plurality of pieces, weakened members, separate membranes (i.e. two-part ends), or they require double seaming. None of the above patents show a simple, one piece, easily manufactured resealable easy open end.

U.S. Pat. No. 6,193,094 B1, entitled "RESEALABLE EASY OPEN CLOSURE AND CAN", issued Feb. 27, 2001, the entire disclosure of which is incorporated herein, discloses a resealable easy open end (REOE) used with a can with a special configuration at the top end. This REOE and its various embodiments is designed to work with liquids and semi solids and solids and course granulated solids. This can/REOE combination may or may not rely on internal pressure to give it rigidity. When the system is used with powders or finely granulated material (such as powdered milk, infant formula, cocoa mix, iced tea mix) there may be an initial powder escape when the REOE is first opened, since the escaping pressurizing gas may entrain some powders at the initial opening. This is also true for some materials which themselves generate gases such as coffee.

SUMMARY OF THE INVENTION

It is an object of the present invention to provide an easy open end which prevents powder from escaping while allowing pressurizing or generated gas to escape without entraining the contents. It is a further object to provide such an end which is resealable.

These and other objects are achieved in accordance with certain principles of the invention by an easy openable closure for a can which includes means, such as a flap or skirt, which operates when the closure is removed from the can to allow gas to escape from the can while preventing escape of the contents of the can.

Other features and advantages of the present invention will become apparent from the following description of the invention which refers to the accompanying drawings.

DETAILED DESCRIPTION OF THE EMBODIMENTS OF THE INVENTION

Figure 1:
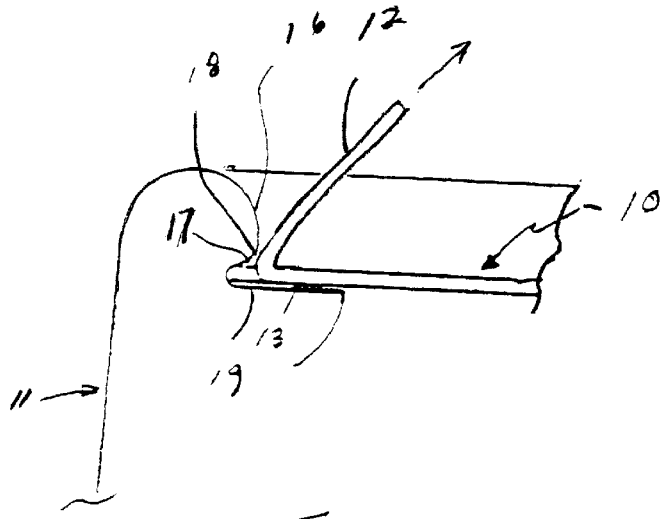
FIG. 1 shows a side view of a can and a sealed-on resealable easy open end in accordance with the invention of U.S. Pat. No. 6,193,094 B1.

Referring to FIG. 1, the system of U.S. Pat. No. 6,193,094 B1 includes a resealable easy open end 10 sealed to a can 11. The end 10 has a pull tab 12 attached thereto and is sealed to the can in a sealing area 13 inward of the can wall.

The can 11 has a curled inner portion 16 with a recess 17 or indentation which forms upper and lower ledges 18 and 19, respectively.

To unseal the easy open end, the tab is moved upwardly. Then a force is applied to the tab 12, which causes the tab to peel away from its seal 13 with the lower ledge 19. The end 10 may then be removed from the can 11 and then resealed by pushing the end downwardly to the periphery until the easy open end 10 snaps into the recess 17.

Figure 2:
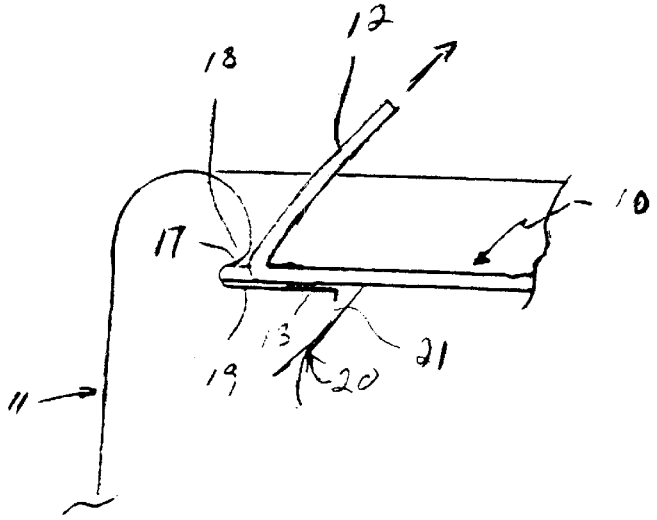
FIG. 2 shows a side view of a can and a sealed-on resealable easy open end in accordance with the present invention.
Figure 3:
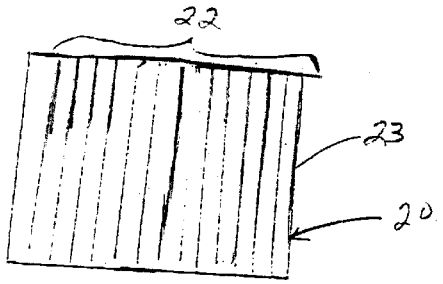
FIG. 3 is a plan view of a flap used in the can and sealed-on reasealable easy open end of FIG. 2.

Referring to FIGS. 2 and 3, there is shown an embodiment of the invention especially suited for sealing a can 11 containing a granulated material, such as powder. The embodiment uses a flap 20 in the bottom of the REOE 10 adjoined to the tab end and which flap 20 is so shaped as to rub along the edge 21 of the sealing ledge 19, which is part of the can, during the initial opening action and which flap 20 has narrow grooves 22 on its rubbing face 23, as best shown in FIG. 3, to permit the pressurizing or generated gas to escape while preventing the powder in the can from escaping. Continued peeling of the REOE 10 then removes the REOE.

Instead of grooves 22 the flap 20 can have small holes or porosities (not shown) through which the pressurizing gas can escape. The flap 20 can also be without grooves and ridges and the grooves and ridges can be on the part 21 of the can along which the flap 20 rubs or that part of the can or the part immediately above the rubbing part can have small holes. Wherever located, the cross sectional size of the grooves or holes is preferably less than the grain size of the powder in the can so as to allow any gas to escape while preventing escape of any powder.

A reverse curvature along the bottom end of the flap 20 makes it easy to replace the REOE. No orientation of the REOE is needed either to first seal it or for reclosing the can. The grooves 22 can be curved or straight and may be of different depths, widths or may be a series of overlapping ridges of projection so that the escape path traps the powder but allows the pressurizing gas to escape without entraining any powder. The length, elasticity etc., of the flap 20 can be adjusted to correspond to the size, lightness and other properties of the powder so as to obtain maximum powder trapping for minimum flap material usage. There is a great environmental advantage to the use of pressurized thin wall metal cans with such a REOE because many of the currently used cans are composites made of paper board and metal foil with metal bottoms. These metal/composite cans and REOE's require a separate plastic cover for resealing. Composite cans are very difficult to recycle and end up in landfills wasting the paper board (even if it is made from recycled paper.) The metal bottom, the metal or composite seal and the separate cover are generally not recoverable.

Steel or aluminum, on the other hand, are perpetually recyclable and the REOE uses very little material since there is only one piece instead of two pieces and, if left on the empty steel can, it will burn off in the steel making process, actually using less energy as is well known in the steel industry.

Figure 4A:
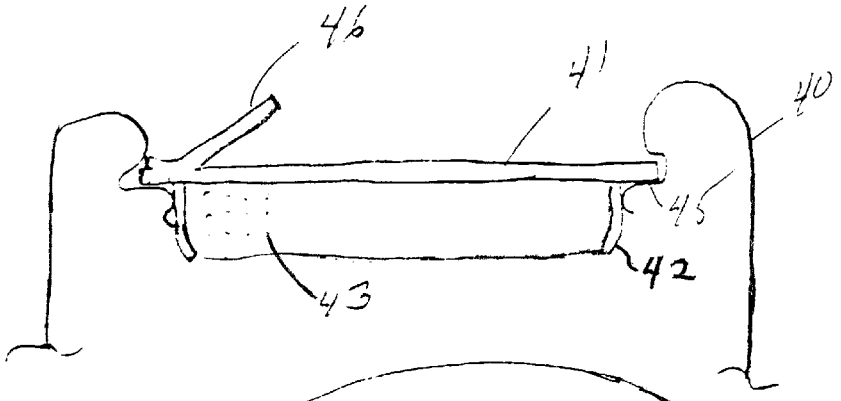
FIG. 4A is a side cross-sectional view of a can and the sealed-on reasealable easy open end in accordance with an alternative embodiment of the invention.
Figure 4B:
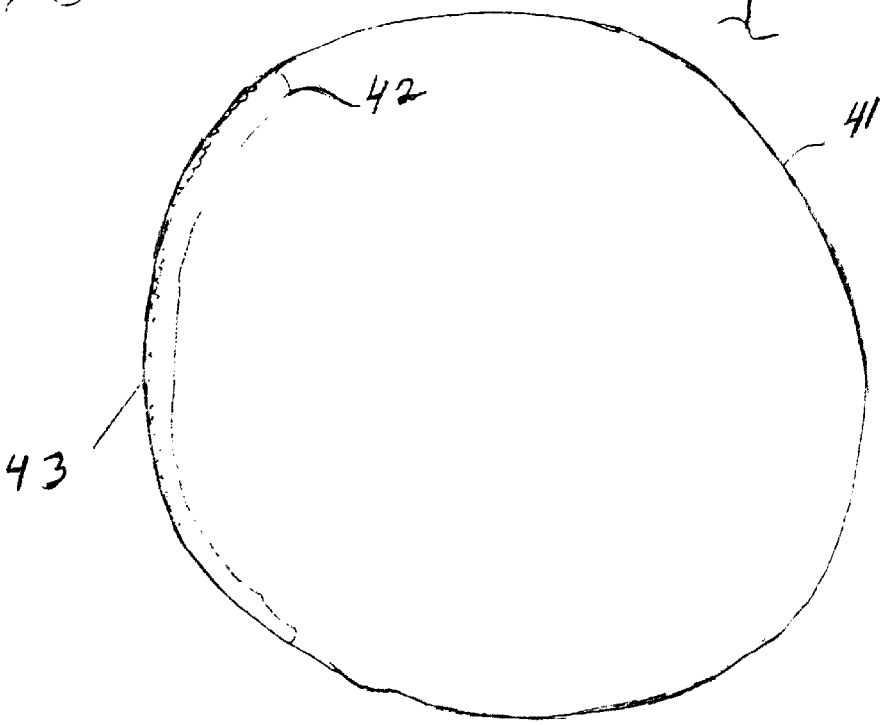
FIG. 4B is a top view of a variation of the end shown in FIG. 4A.

Another embodiment of the invention having a full open resealable easy open end is shown in FIG. 4A with a variant of the end shown in FIG. 4B. Referring first to FIG. 4A, there is shown a can 40 and an easy open end 41 having a depending annular skirt 42. The easy open end 41 may be advantageously made by vacuum forming or by injection molding so that an integral pull tab 46 is formed. In accordance with the invention, the annular skirt 42 has holes or grooves therein. The annular skirt 42 may extend about the entire periphery of the easy open end or may extend only in an area slightly larger than the extent of the initial opening resulting when the easy open end is removed from the can, as shown in FIG. 4B. As will be appreciated, instead of the integral pull tab 46, a two part end (not shown) may also be employed. A sealing adhesive (not shown) can be applied to both or either the under side of the easy open end 41 and/or the sealing surface 45 of the can.

Figure 5:
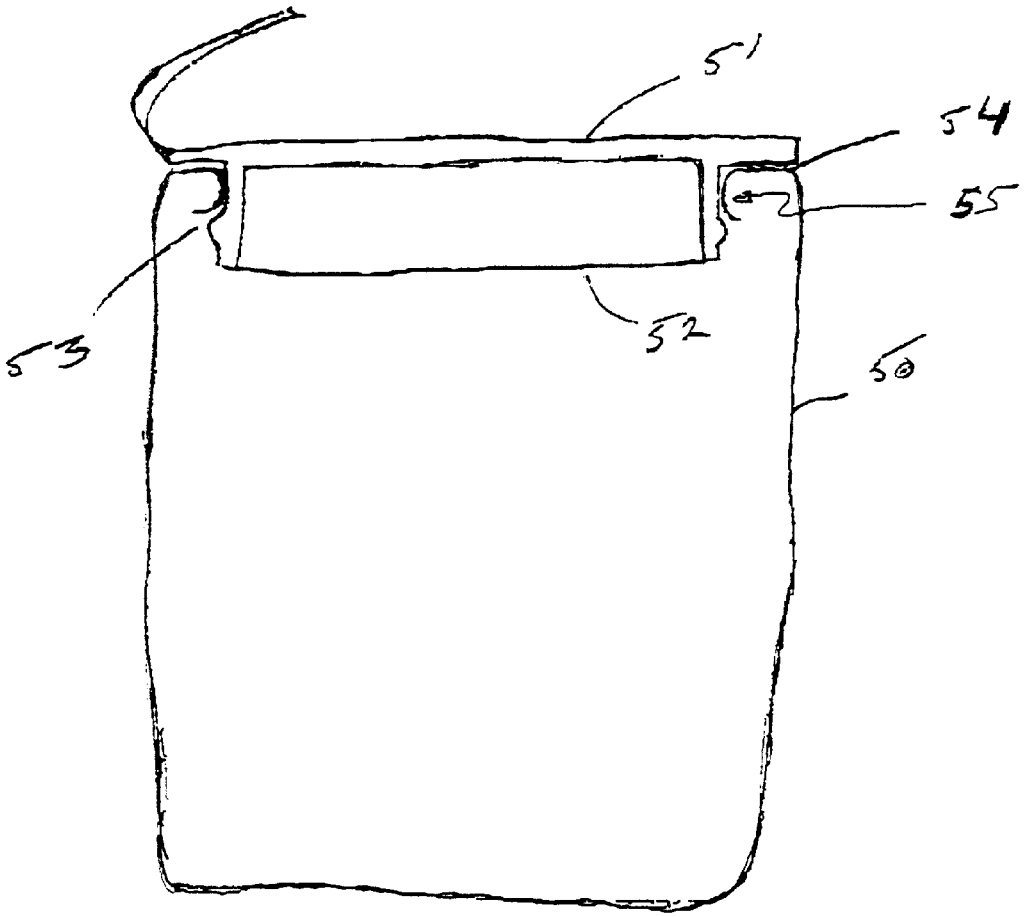
FIG. 5 is a side cross-sectional view of a can and a sealed-on resealable easy open end in accordance with still another embodiment of the invention.
Figure 6:
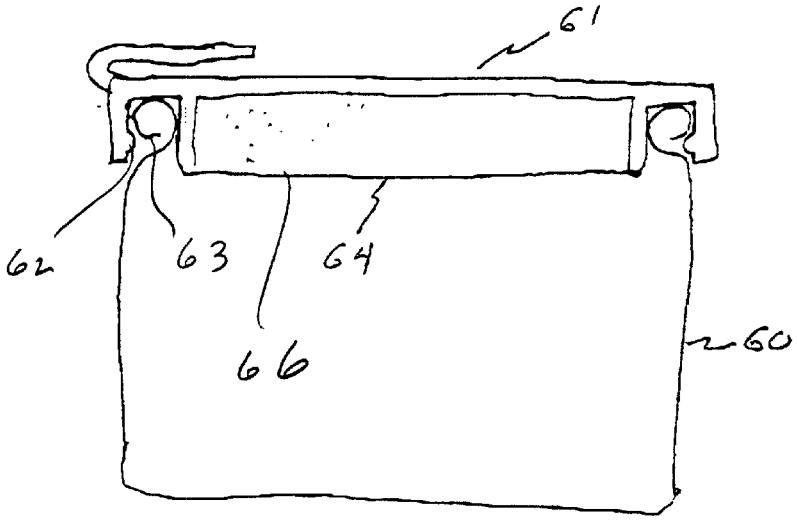
FIG. 6 is a side cross-sectional view of a can and a sealed-on resealable easy open end in accordance with yet another embodiment of the invention.

Another embodiment of a can and easy open end is shown in FIG. 5. As shown in FIG. 5, this embodiment includes a can 50 and an easy open end 51 having a depending annular collar 52 with a small projection or a detent ring 53 extending outwardly therefrom. The top of the can includes a flat sealing surface 54. The collar 52 may include holes or grooves (as shown in FIG. 4A), or alternatively, the holes or grooves 53 may be formed in the can itself on the portion 55.

An improvement of the easy open closure and can shown in U.S. Pat. No. 6,193,094B1 is disclosed in U.S. Provisional Appln. Serial No. 60/265,481, entitled "AN IMPROVED RECLOSABLE EASY OPEN END COVER FOR NON-PROCESSED FOODS AND OTHER PRODUCTS", filed Jan. 31, 2001.

The easy open end shown in U.S. Ser. No. 60/265,481 comprises a plastic (or plastic in combination with other materials, or some other suitable resilient material) cover 61 shaped to snap over the open end of a can 60 with a peelable seal being formed between the underside of the cover and the top of the opening of the container. This seal can be an adhesive material that bonds the two parts together and the bond can be activated by a variety of means including thermal energy, ultrasonics, UV or other radiation, RF energy, inertial or spin welding, etc. The seal can also be made by simply melting a thin layer of the resilient material of the cover 61 where it is in contact with the open end of the can 60 causing the cover 61 to bond to the open end of the can forming a peelable seal between the two parts.

To open the can, one simply pulls upwards on the periphery of the cover (a pull tab or push tab may be provided to facilitate opening) and peels the cover away from the top edge of the can, thus, breaking the adhesive primary seal between the can and the opening of the container. To reclose the can, one places the cover over the top opening of the can and presses it into place.

A ledge or detent 62 in the cover snaps over a matching ledge or detent 63 on the can 60 and forms a seal between the can 60 and the cover 61.

In accordance with certain principles of this invention, the cover 61 is provided with a depending skirt 64. As in the previous embodiments, holes or grooves 66 may be provided in the skirt 64, or alternatively, may be provided in the can 60.

The term "can" as used herein and in the appended claims means any receptacle, such as a metal can, a plastic container, a glass container or any similar object with which it is desired to use a resealable easy open end.

Further, although the invention has been described in connection with a resealable easy open end, its applicability is not so limited, and it may be used in connection with any easy open end.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In combination, a can and an easy openable closure for said can, said can comprising a hollow body closed at a first end and an opposite second end closed by said closure;

said closure being bonded to said hollow body but being releasable from said body upon the application of a sufficient force to said body and comprising means operable when said closure is removed from the can to allow gas to escape from the can while preventing escape of the contents of the can; and a pull tab on said closure for pulling the closure to apply said sufficient force to release the closure from at least part of the body, said closure and said body having respective cooperating means so that said closure may be resealable to the body by engagement of the cooperating means.

2. The combination of a can and easy open closure according to claim 1, wherein said means comprises a flap which cooperates with said can as said closure is removed to allow gas to escape from the can while preventing escape of the contents of the can.

3. The combination of a can and easy open closure according to claim 2, wherein the flap includes a plurality of grooves or openings for allowing gas to escape from the can while preventing escape of the contents of the can.

4. The combination of a can and easy open closure according to claim 3, wherein the can is designed to contain a powder or granular material and the size of the grooves or the openings is less than the grain size of the powder or granular material.

5. The combination of a can and easy open closure according to claim 2, wherein said can has holes or grooves which cooperate with the flap to allow gas to escape from the can.

6. The combination of a can and easy open closure according to claim 5, wherein the can is designed to contain a powder or granular material and the size of the grooves or the openings is less than the grain size of the powder or granular material.

7. The combination of a can and easy open closure for said can, said can comprising a hollow body closed at a first end and an opposite second end enclosed by said closure, said closure being bonded to said hollow body but being releasable from said body upon the application of a sufficient force to said body and comprising a depending annular skirt which cooperates with the can to allow the escape of gas from the can while preventing escape of the contents of the can when the closure is removed from the can; and a pull tab on said closure for pulling said closure to apply said sufficient force to release the closure from at least part of the body, said closure and said body having respective cooperating means so that said closure may be resealable to the body by engagement of the cooperating means.

8. The combination of a can and easy open closure according to claim 7, wherein the annular skirt includes a plurality of grooves or openings for allowing gas to escape from the can while preventing escape of the contents of the can.

9. The combination of a can and easy open closure according to claim 8, wherein the can is designed to contain a powder or granular material and the size of the grooves or the openings is less than the grain size of the powder or granular material.

10. The combination of a can and easy open closure according to claim 7, wherein said can has holes or grooves which cooperate with the annular skirt to allow gas to escape from the can.

11. The combination of a can and easy open closure according to claim 10, wherein the can is designed to contain a powder or granular material and the size of the grooves or the openings is less than the grain size of the powder or granular material.

12. The combination of a can and easy open closure according to claim 7, wherein said cooperating means of said closure and said can comprise cooperating detents so that said closure may be resealed to the can by engaging the detent of the closure with the detent of the can.

13. The combination of a can and easy open closure according to claim 12, wherein the cover is made of a resilient material and the cover is resealed to the can by snapping the detent of the cover over the detent of the can.

14. The combination of a can and easy open closure according to any one of claims 1–13, wherein the can and the closure are so structured and arranged that the closure may reseal the can after being removed therefrom.

* * * * *